US006233886B1

(12) United States Patent
Andres

(10) Patent No.: US 6,233,886 B1
(45) Date of Patent: May 22, 2001

(54) FLOOR ASSEMBLY AND ASSOCIATED METHOD OF MAKING A FLOOR ASSEMBLY

(75) Inventor: Thomas J. Andres, North Versailles, PA (US)

(73) Assignee: Thermal Industries, Inc., Pittsburgh, PA (US)

( * ) Notice: Subject to any disclaimer, the term of this patent is extended or adjusted under 35 U.S.C. 154(b) by 0 days.

(21) Appl. No.: 09/274,602

(22) Filed: Mar. 23, 1999

(51) Int. Cl.[7] ..... E04F 11/16

(52) U.S. Cl. ..... 52/177; 52/489.1; 52/263; 405/218; 114/366; 114/267

(58) Field of Search ..... 52/177–180, 181, 52/263, 588.1, 489.1, 424, 506.08, 506.09; 405/218, 219, 220; 114/366, 267

(56) References Cited

U.S. PATENT DOCUMENTS

| | | | |
|---|---|---|---|
| 3,815,550 | 6/1974 | Becker . | |
| 3,914,913 | 10/1975 | Roberts . | |
| 4,078,515 | 3/1978 | Svirklys . | |
| 4,135,339 | 1/1979 | Pawlitschek . | |
| 4,964,618 | 10/1990 | Kennedy et al. . | |
| 5,009,045 | 4/1991 | Yoder . | |
| 5,048,448 | 9/1991 | Yoder . | |
| 5,351,458 * | 10/1994 | LeHe | 52/177 X |
| 5,553,427 | 9/1996 | Andres . | |
| 5,617,689 * | 4/1997 | Beane | 52/489.1 |
| 5,660,016 * | 8/1997 | Erwin et al. | 52/738.1 X |
| 5,950,377 * | 9/1999 | Yoder | 52/177 |

* cited by examiner

*Primary Examiner*—Richard Chilcot
(74) *Attorney, Agent, or Firm*—David V. Radack; William F. Lang, IV; Eckert Seamans Cherin & Mellott, LLC

(57) ABSTRACT

A floor assembly includes at least two elongated extrusions disposed adjacent to each other where each extrusion includes a pair of outer leg members and a pair of inner leg members that are connected by a connector which engages the inner leg member and the outer leg member of one of the extrusions and the outer leg member and the inner leg member of the other extrusion. The connector includes a base and first and second end flanges where the first end flange engages the inner leg member of one of the extrusions and the second end flange engages the inner leg member of the other extrusion. A method of making a floor assembly is also disclosed.

22 Claims, 7 Drawing Sheets

FLOOR ASSEMBLY AND ASSOCIATED METHOD OF MAKING A FLOOR ASSEMBLY

BACKGROUND OF THE INVENTION

This invention relates to a floor assembly, and an associated method of making a floor assembly. More particularly, this invention relates to plastic extrusions which are connected by a connector in order to form a floor assembly.

It is known to use plastic extrusions for floor assemblies. For example, U.S. Pat. No. 5,553,427 discloses such a plastic extrusion. This particular extrusion is for use in a floor assembly that is secured to a rigid underlying support by a snap connector adapted to be attached to the underlying rigid support for securing the extrusions to the rigid underlying support. The snap connector secures a single extrusion to the underlying rigid support.

U.S. Pat. No. 3,815,550 discloses a slatted floor assembly for animal enclosures and the like. The floor assembly consists of a set of elongated extruded plastic members wherein a plurality of clip-like elements maintain the members in a spaced longitudinally parallel relationship. The elements are provided with a central, upright spacer and a pair of arms. Holding means in the form of notches which cooperate with projections are disposed at the outer ends of the arms to releasably receive and exteriorly grip the extruded members.

Despite the existence of these plastic extrusions and floor assemblies formed thereby, there is needed an improved floor assembly, and associated method of making a floor assembly, which can be conveniently assembled and/or disassembled, as well as, economically produced.

SUMMARY OF THE INVENTION

This invention has met or surpassed the above-mentioned needs, as well as others. Specifically, the invention includes a floor assembly comprising at least two elongated extrusions disposed adjacent to each other where each extrusion includes a pair of outer leg members and a pair of inner leg members. The floor assembly further comprises a connector for connecting one of the extrusions to the other extrusion where the connector engages the inner leg member and the outer leg member of one of the extrusions and the outer leg member and the inner leg member of the other extrusion. The connector includes a base and a first end flange and a second end flange extending from opposed ends of the base, the first end flange engaging the inner leg member of one of the extrusions and the second end flange engaging the inner leg member of the other extrusion. The floor assembly may also include a tab projecting from the end of the base on which the second end flange is disposed, whereby the tab can be used to secure the base, if desired, to a subfloor structure underlying the floor assembly.

A method of making a floor assembly is also included and comprises providing a first extrusion and a second extrusion, each of the extrusions having a first outer leg member, a second outer leg member, a first inner leg member, and a second inner leg member. The method also includes providing a first connector and attaching the first connector to the second inner leg member of the first extrusion. The method further provides for securing said first inner leg member of the second extrusion to the first connector in order to form a floor assembly made of the first and second extrusions.

The method may also include providing a third extrusion having a first outer leg member, a second outer leg member, a first inner leg member, and a second inner leg member, and providing a second connector. Next, before securing the second extrusion to the first connector, the method provides for attaching the second connector to the second inner leg member of the second extrusion and subsequently securing the first inner leg member of the second extrusion to the first connector. This is followed by securing the first inner leg member of the third extrusion to the second connector to form a floor assembly made of the first, second and third extrusions.

BRIEF DESCRIPTION OF THE DRAWINGS

A full understanding of the invention can be gained from the following detailed description of the invention when read in conjunction with the accompanying drawings in which.

DETAILED DESCRIPTION

The plastic extrusions shown herein are used to form floor assemblies, such as an outdoor residential deck. It will be appreciated, however, that there are numerous other uses for the plastic extrusions and connectors disclosed herein including, but not limited to, boat docks, enclosure patios, dance floors or any flooring assembly where other materials, such as wood, are currently used. Therefore, although the description set forth herein focuses on a residential deck, it will be appreciated that the invention is not so limited and can encompass other flooring assemblies such as those mentioned above as well as more.

Figure 1:
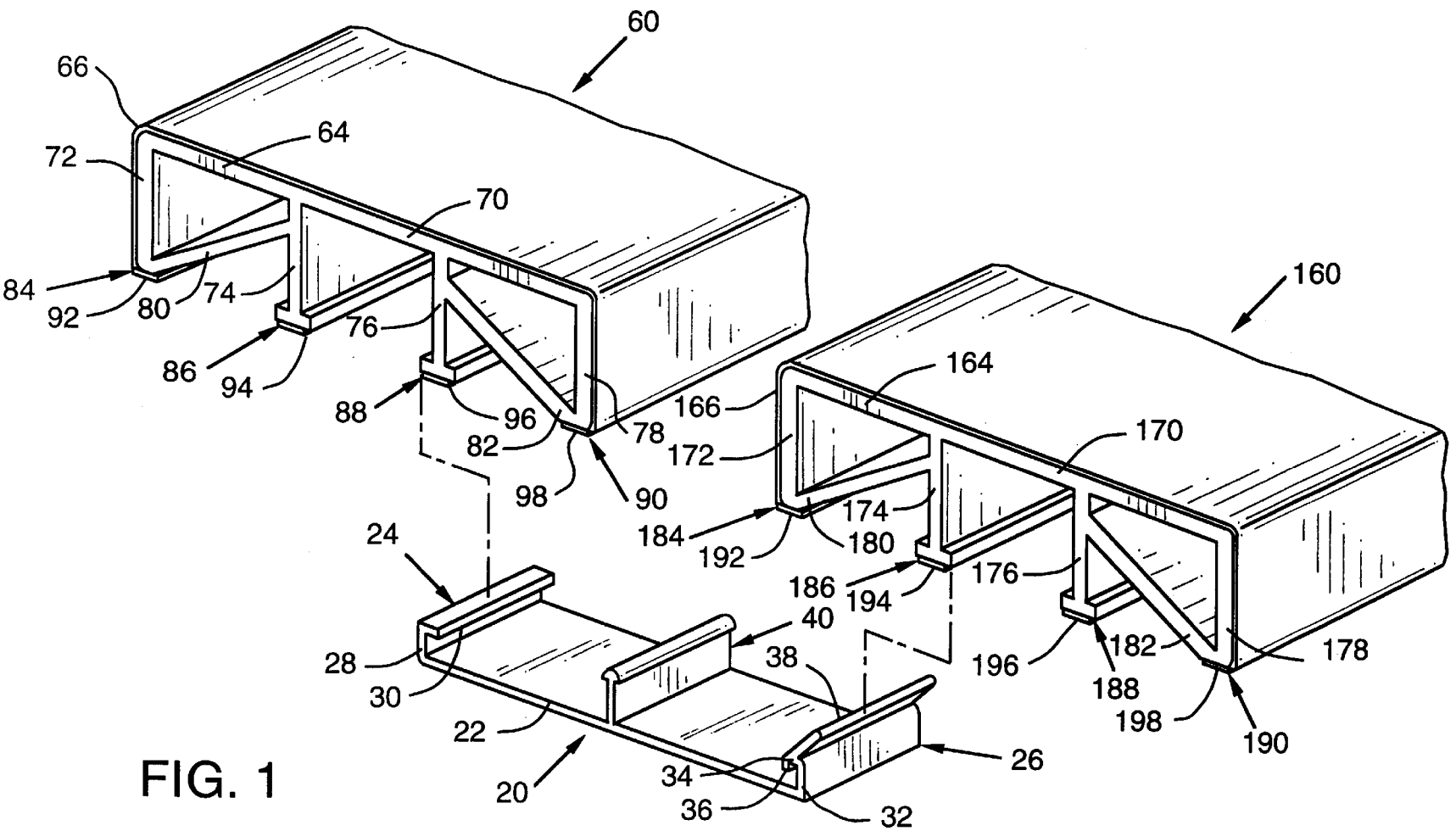
FIG. 1 is an exploded isometric view of the floor assembly of the invention.

Referring now to FIG. 1, there is shown an exploded isometric view of a preferred embodiment of the components making up the floor assembly of the invention. The floor assembly comprises a connector 20 for connecting a first extrusion 60 to a second extrusion 160. This arrangement, as will be explained in more detail herein, allows for quick and easy assembly and disassembly of the floor assembly without the need for a permanent or otherwise underlying structure.

The connector 20, which is preferably made of aluminum or other similar material, includes a base 22 and a pair of end flanges extending from opposed ends of the base 22, namely, first end flange 24 and second end flange 26. The first end flange 24 includes a first section 28 which extends generally perpendicularly from the base 22 and a second section 30 which extends inwardly and generally perpendicular from the first section 28. The first section 28 and the second section 30 of the first end flange define a first recessed space for receiving a portion of the first extrusion 60 to resist undesired movement of the first extrusion 60 with respect to the connector 20, as will be explained in more detail herein. The second end flange 26 includes a first section 32 extending generally perpendicularly from the base 22, a second section 34 extending inwardly and generally perpendicularly to the first section 32, a third section 36 extending downwardly and generally perpendicularly from the second section 34, and a pilot surface 38 extending angularly from the second section 34 to facilitate connection of the second extrusion 160 to the connector 20. The first section 32, the section 34, and third section 36 of the second end flange 26 define a second recessed space for receiving a portion of the second extrusion 160 in order to resist undesired movement of the second extrusion with respect to the connector 20 as will be explained in more detail herein.

The connector 20 also includes an intermediate flange 40 extending generally perpendicularly from the base 22 and positioned intermediate or between the first end flange 24 and the second end flange 26. The intermediate flange 40 is disposed in a space defined between the first extrusion 60 and the second extrusion 160. The intermediate flange 40 maintains the first extrusion in a spaced relation to the second extrusion 160.

Still referring to FIG. 1, the extrusion 60 consists of a substrate 64 made, preferably, of a recycled polyvinyl chloride (PVC) material, however, any extruded plastic material can be used. The substrate 64 is covered by a virgin capstock material 66 which is co-extruded onto the substrate 64 by known methods. The virgin capstock material 66 is preferably a weatherable, hard virgin polyvinyl chloride (PVC) material. The structure of the first extrusion 60 includes a load-bearing horizontal portion 70. The first extrusion 60 also includes a first outer leg member 72, a second outer leg member 78, a first inner leg member 74 and a second inner leg member 76, all of which extend generally perpendicular to the load-bearing horizontal portion 70. Two angular cross-members 80 and 82 are provided having ends connected to legs 72 and 74 and legs 76 and 78, respectively. It will further be seen that leg 72 has a foot section 84 that extends generally perpendicularly to leg 72 and which contacts the base 22 of the connector 20, as will be described in more detail herein. Similarly, legs 74, 76 and 78 each include foot sections 86, 88, 90, respectively. A soft, polyvinyl chloride (PVC) layer 92, 94, 96, and 98 may be applied to the bottom surface of each of the foot sections 84, 86, 88 and 90, respectively.

Similarly, the second extrusion 160 consists of a substrate 164 covered by a virgin capstock material 166. The second extrusion 160 also includes a load-bearing horizontal portion 170, a first outer leg member 172, a second outer leg member 178, a first inner leg member 174 and a second inner leg member 176. Angular cross members 180 and 182 are provided having ends connected to legs 172 and 174 and legs 176 and 178, respectively. Foot sections 184, 186, 188 and 190 extend generally perpendicularly from legs 172, 174, 176 and 178, respectively. A soft, polyvinyl chloride layer 192, 194, 196, and 190 is applied to the bottom surface of the foot sections 184, 186, 188 and 190, respectively. Accordingly, it will be appreciated that the first extrusion 60 and the second extrusion 160 are essentially identical to one another. A detailed description of a typical extrusion is set forth in U.S. Pat. No. 5,553,427, the complete disclosure of which is hereby incorporated by reference.

Figure 2:
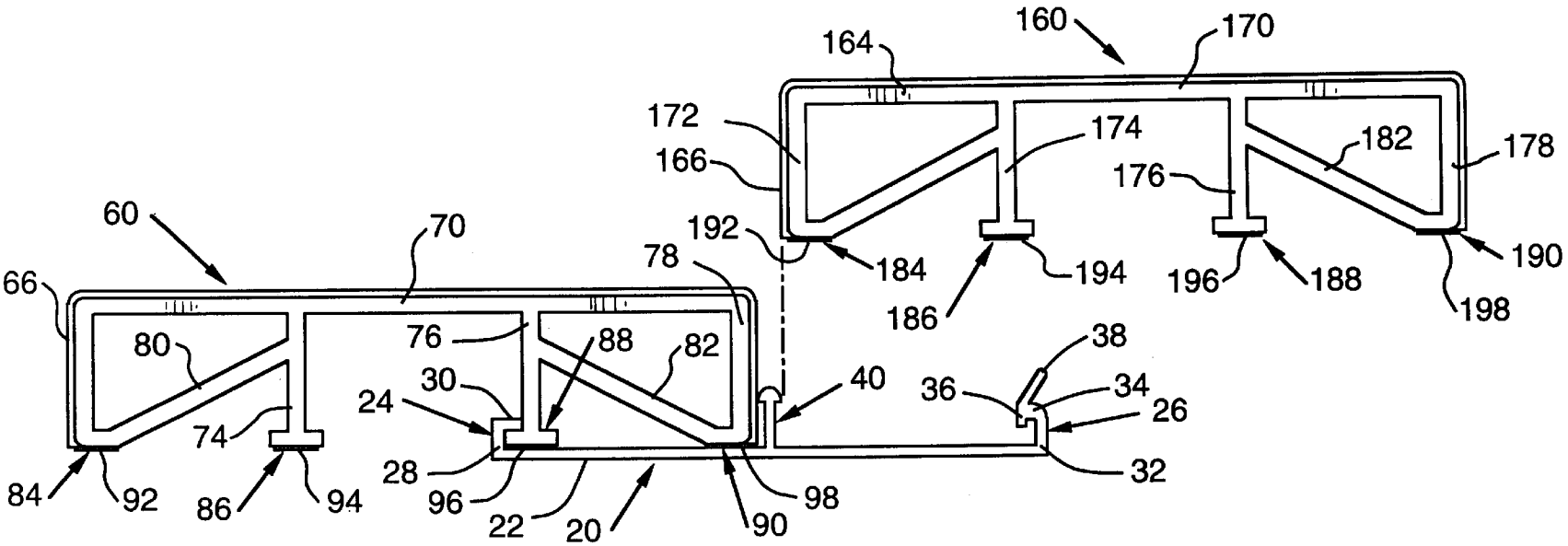
FIG. 2 is an end view of the floor assembly of the invention partially assembled.
Figure 3:
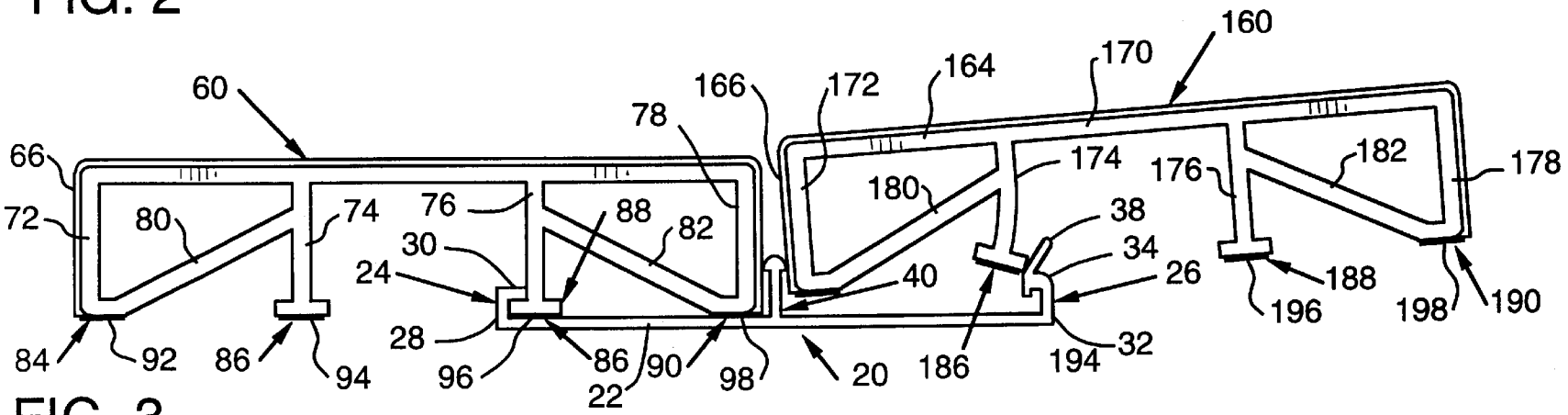
FIG. 3 is an end view of the invention, similar to FIG. 2, illustrating the assembly of the floor assembly.
Figure 4:
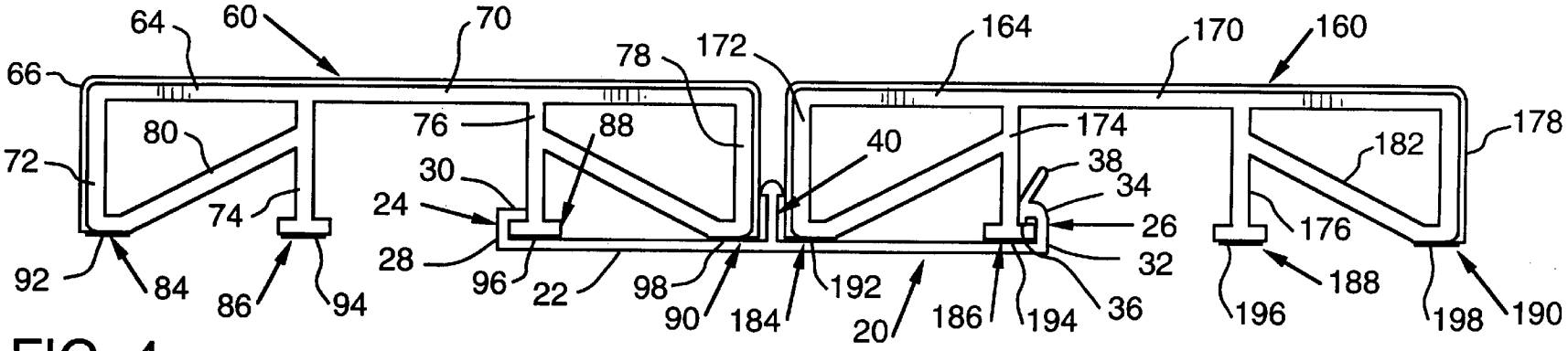
FIG. 4 is an end view of the invention, similar to FIGS. 2 and 3, illustrating the floor assembly as assembled.

Referring to FIGS. 2–4, a method of making a floor assembly utilizing the connector 20, first extrusion 60 and second extrusion 160 will be explained. First, the connector 20 is attached to the first extrusion 60 with the second inner leg member 76, and more specifically, the foot section 88 thereof engaging into the first recessed space defined by the first section 28 and the second section 30 of the first end flange 24. (FIG. 2). Specifically, this is accomplished by placing the second section 30 of the first end flange 24 adjacent the foot section 88 and the second inner leg member 76 and then rotating the connector 20 counter-clockwise as viewed in FIG. 2, which results in the foot section 88 being received in the first recessed space defined by the first section 28 and the second section 30 of the first end flange 24. This also results in the intermediate flange 40 being positioned adjacent the second outer leg member 78 of the first extrusion 60 in order to maintain the second extrusion 160 in a spaced relation with the first extrusion 60. The foot section 90 of the first extrusion 60, along with foot section 88, rests up on the base 22 of the connector 20.

In order to connect the second extrusion 160 to the connector 20, the second extrusion 160 is merely pressed down on the connector 20, thus forcing the resilient leg 174 to bend outwardly (FIG. 3). The bending of the leg member 174 is facilitated by the angular orientation of the pilot surface 38. Once the second extrusion 160 is pressed down far enough to allow the foot section 186 of leg 174 to clear the bottom of the third section 36 of the second end flange 26, leg 174 along with foot section 186 snap into the position shown in FIG. 4. The second extrusion 160 is thus securely connected to the connector 20. More specifically, the foot section 186 of leg 174 is received in the second recessed space defined by the first section 32, second section 34 and third section 36 of the second end flange 26. Receipt of the foot section 186 in the second recessed space resists undesired movement of the second extrusion 160 with respect to the connnector 20.

Once the first extrusion 60 and the second extrusion 160 are connected to the connector 20 (FIG. 4) the intermediate flange 40 maintains the second outer leg member 78 of the first extrusion 60 and the first outer leg member 172 of the second extrusion 160 in a spaced relation. In addition, the cooperation between the second inner leg member 76 of the first extrusion 60 and the first end flange 24 of the connector 20, along with the cooperation between the first inner leg member 174 of the second extrusion 160 and the second end flange 26 of the connector 20, the connector 20 is mechanically secured to the first extrusion 60 and the second extrusion 160 in order to form the desired floor assembly. More specifically, the cooperation between the second section 30 of the first end flange and the foot section 88 of leg 76, along with the cooperation between the third section 36 of the second end flange 26 and the foot sections 186 of 174 resists undesired movement of the first extrusion 60 and the second extrusion 160 with respect to the connector 20.

It will be appreciated that the substrate 64 from which the first extrusion 60 is formed, as well as the substrate 164 from which the second extrusion 160 is formed is preferably, as stated, a recycled polyvinyl chloride (PVC) material, however, any extruded plastic material can be used. In order to facilitate the extrusions being snapped onto the connector 20, i.e., the leg 174 bending outwardly due to engagement with the pilot surface 38 as described, for example, the substrate material is preferably a resilient material which bends sufficiently to allow the extrusions to be pressed onto the connector 20 and then to snap into place and mechanically secure each of the elongated extrusions to the connector 20.

Figure 5:
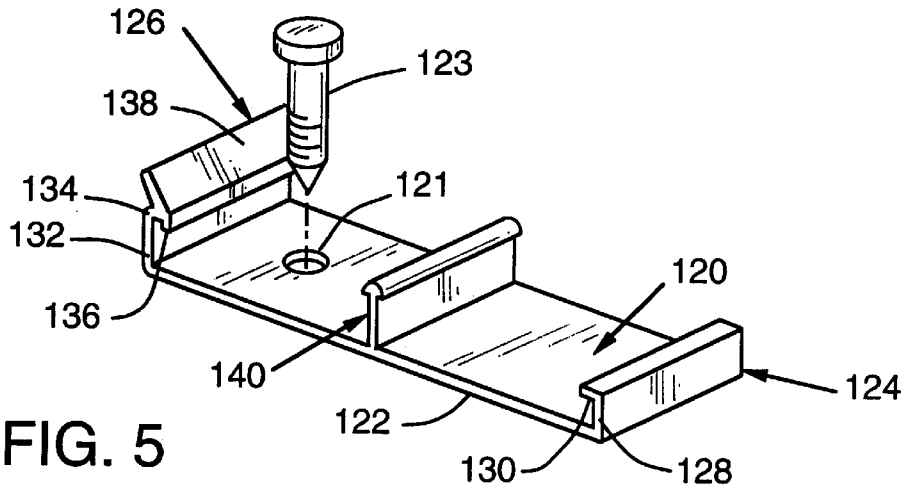
FIG. 5 is an exploded isometric view of another embodiment of the connector of the floor assembly.
Figure 6:
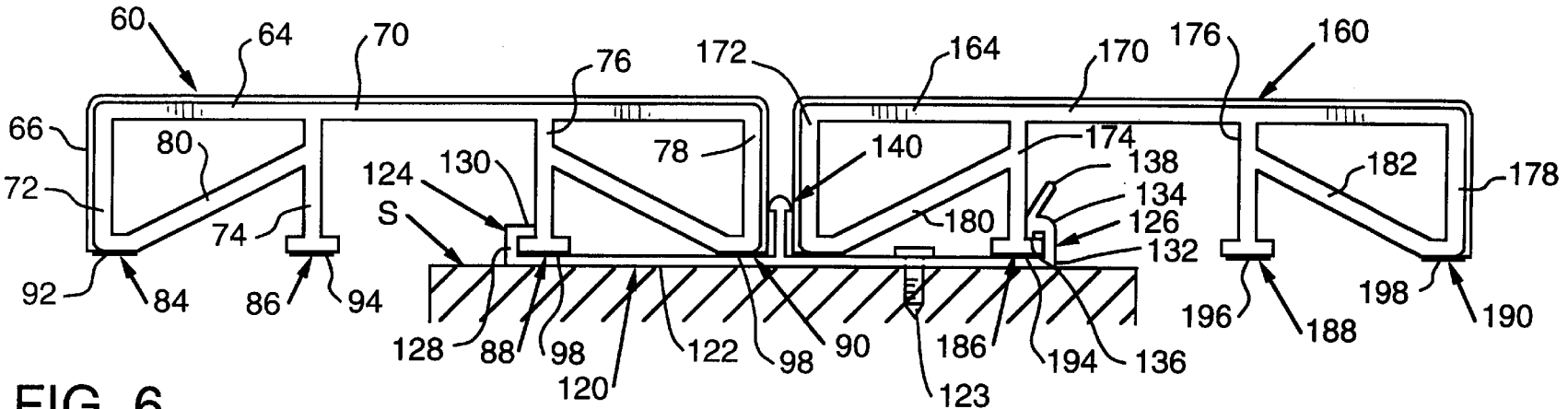
FIG. 6 is an end view of the connector embodiment shown in FIG. 5, illustrating the floor assembly as assembled.

Referring to FIGS. 5 and 6, there is shown another embodiment of a connector 120 for connecting the first extrusion 60 and a second extrusion 160. The connector 120 is similar to the connector 20 as described herein and includes a base 122, a first end flange 124 and a second end flange 126. Similar to the connector 20, the first end flange 124 of the connector 120 includes a first section 128 and a second section 130 for cooperating with the leg members of the extrusions, as described herein. In addition, the second end flange 126 includes a first section 132, a second section 134, a third section 136 and a pilot surface 138 for cooperating with the leg members of the extrusions, as described herein. The connector 120 further includes an aperture 121 in the base 122 and positioned intermediate the second end flange 126 and the intermediate flange 140. A fastening means, such as a screw 123 or other similar means, is received in the aperture 121 in order to secure the connector 120 to a sub-floor structure S (FIG. 6) if desired. This allows for the connector 120 and the floor assembly formed thereby along with the first extrusion 60 and the second extrusion 160, as well as additional extrusions if desired, to be more permanently secured to the sub-floor structure S. By providing for the aperture 121 to be formed in the base 122 intermediate the second end flange 126 and the intermediate flange 140, the connector 120 may be connected to the first extrusion 60, as described herein, and then prior to the second extrusion 160 being snapped into place on the connector 120, the screw 123 is inserted through the aperture 121 and into the sub-floor structure S. Once the screw 123 has been secured into position, the second extrusion 160 may then be connected to the connector 120 as described herein.

Figure 7:
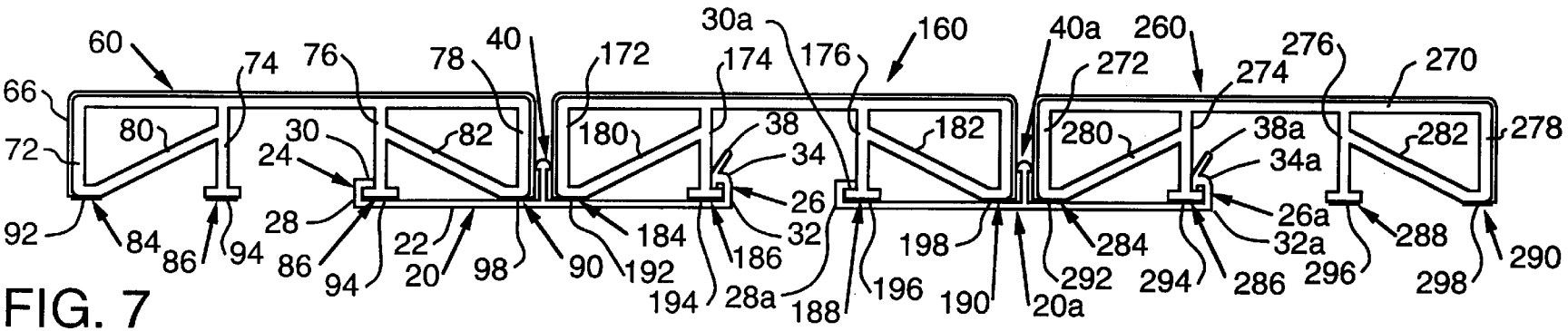
FIG. 7 is an end view, similar to FIG. 4, illustrating three extrusions and two connectors as assembled to form the floor assembly.

Referring to FIG. 7, it is illustrated that a plurality of extrusions disposed adjacent to each other, each pair of adjacent extrusions being connected by at least one connector, may be provided for forming the floor assembly. Specifically, the first extrusion 60 and the second extrusion 160 are connected by the connector 20, as described herein. In addition, a third extrusion 260 is provided and is connected to the second extrusion 160 by another connector 20*a*. Of course it should be appreciated that the first extrusion 60 and the second extrusion 160 may be connected by more than one connector 20 and, similarly, the second extrusion 160 and the third extrusion 260 may be connected by more than one connector 20*a*.

In forming the floor assembly shown in FIG. 7, prior to securing the second extrusion 160 to the connector 20, the connector 20*a* is attached to the second extrusion 160 in the same manner as the connector 20 is initially connected to the first extrusion 60, as described herein. Once the connector 20*a* is attached or connected to the second extrusion 160, the second extrusion 160 may be secured to the connector 20, as described herein. Next, the third extrusion 260 is connected to the connector 20*a* in essentially the same manner as the second extrusion 160 is connected to the connector 20, as described herein. Of course, the addition of further extrusions connected by additional connectors may be provided to form a larger floor assembly. This is accomplished by repeating the steps described herein for connecting the first extrusion 60 with the second extrusion 160 and the second extrusion 160 with the third extrusion 260. Of course, the floor assembly shown in FIG. 7 may be disassembled by unattaching the first extrusion 60 and the second extrusion 160 from the connector 20 and also unattaching the second extrusion 160 and the third extrusion 260 from the connector 20*a*. Advantageously, this allows for the floor assembly to be constructed in the manner described herein in order to provide a temporary or non-permanent floor assembly that may be disassembled as needed.

Figure 8:
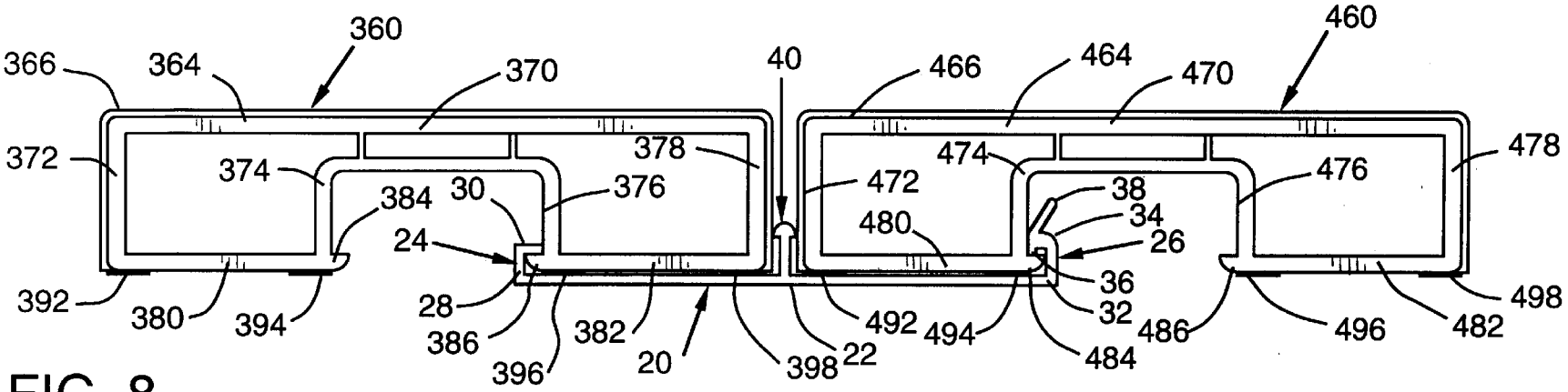
FIG. 8 is an end view, similar to FIG. 4, illustrating a further embodiment of the extrusion used to form the floor assembly.

Referring to FIG. 8, there is shown another embodiment of the extrusions which may be connected by connector 20 in order to form a floor assembly. Specifically, the first extrusion 360 and the second extrusion 460 are generally as described in detail in Applicants' co-pending U.S. Pat. Application Ser. No. 09/088,250, filed June 1, 1998, the complete disclosure of which is hereby incorporated by reference. The first extrusion 360 consists of a substrate 364 that is preferably covered by a virgin capstock material 366. The structure of the extrusion 360 includes a load-bearing horizontal portion 370, a first outer leg member 372, a second outer leg member 378, a first inner leg member 374 and a second inner leg member 376, all of which extend generally perpendicularly from the load-bearing horizontal portion 370. Horizontal support members 380 and 382 are provided having ends connected to outer leg member 372 and inner leg member 374, and to inner leg member 376 and outer leg member 378, respectively. It will further be seen that inner leg member 374 and 376 have retaining tabs 384 and 386 respectively that extend generally inwardly therefrom. A soft, polyvinyl chloride (PVC) layer 392, 394, 396 and 398 are applied to the bottom surface of each of the horizontal support members 380 and 382.

Similarly, the second extrusion 460 consists of a substrate 464 that is preferably covered by a virgin capstock material 466. The structure of the extrusion 460 includes a load-bearing horizontal portion 470, a first outer leg member 472, a second outer leg member 478, a first inner leg member 474 and a second inner leg member 476, all of which extend generally perpendicularly from the load-bearing horizontal portion 470. Horizontal support members 480 and 482 are provided having ends connected to outer leg member 472 and inner leg member 474, and to inner leg member 476 and outer leg member 478, respectively. It will further be seen that inner leg member 474 and 476 have retaining tabs 484 and 486 respectively that extend generally inwardly therefrom. A soft, polyvinyl chloride (PVC) layer 492, 494, 496 and 498 are applied to the bottom surface of each of the horizontal support members 480 and 482.

Still referring to FIG. 8, the first extrusion 360 and the second extrusion 460 are shown as connected to the connector 20. FIG. 8 is similar to the view shown in FIG. 4 only the additional embodiment of the first extrusion 360 and the second extrusion 460 are shown in FIG. 8. Otherwise, the connection of the first extrusion 360 and the second extrusion 460 to the connector 20 is essentially the same as described for the extrusions 60 and 160. The connector 20 is first connected to the first extrusion 360 where the first retaining tab 386 formed adjacent the second inner leg member 376 is received in the first recessed space defined by the first section 28 and the second section 30 of the first end flange 24. The first retaining tab 386 engages into the first recessed space in order to resist undesired movement of the first extrusion 360 with respect to the connector 20. Similarly, the retaining tab 484 formed adjacent the first inner leg member 474 of the second extrusion 460 is received in the second recessed space defined by the second end flange 26. The retaining tab 484 which engages into the second recessed space resists undesired movement of the second extrusion 460 with respect to the connector 20.

Figure 8A:
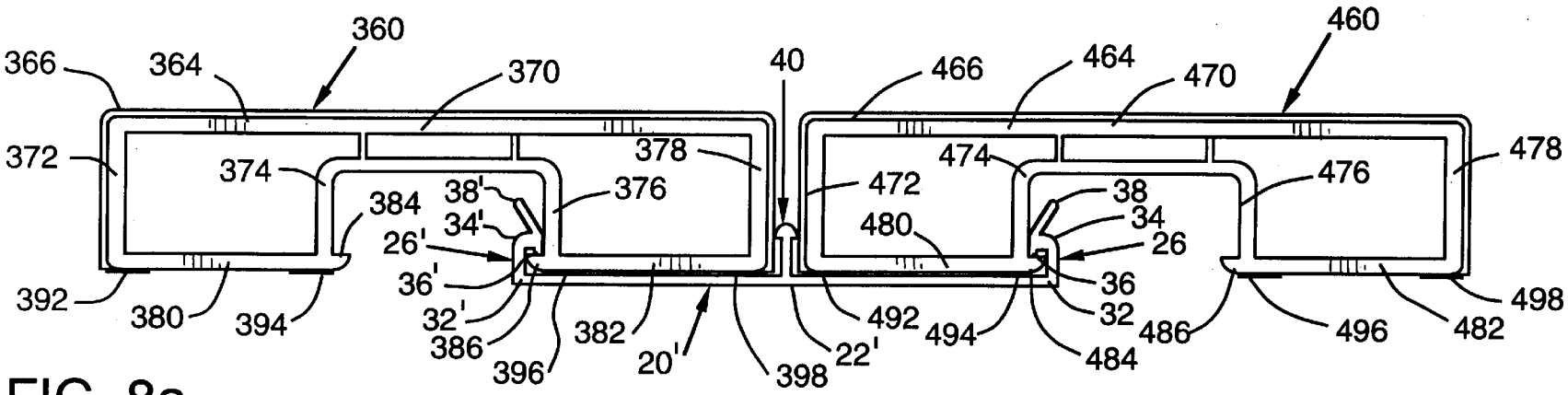
FIG. 8*a* is an end view, similar to FIG. 8, illustrating a further embodiment of the connector used to form the floor assembly.

Referring to FIG. 8*a,* there is shown another embodiment of the invention. Specifically, connector 20' includes a first end flange 26' for securing the first extrusion 360 to connector 20'. The flange 26' is similar in structure and operation to second end flange 26, as described herein, and includes a first section 32' extending generally perpendicularly from base 22', a second section 34', a third section 36' and a pilot surface 38'. In this embodiment, the first extrusion 360 may be secured or connected to the connector 20' before or after securing the second extrusion 460 thereto. This is accomplished in a similar manner as described herein for securing the second extrusion to the connector. It will be appreciated that the connector 20' having first end flange 26' and second end flange 26 may also be utilized with the extrusions 60 and 160, which have been described herein.

Figure 9:
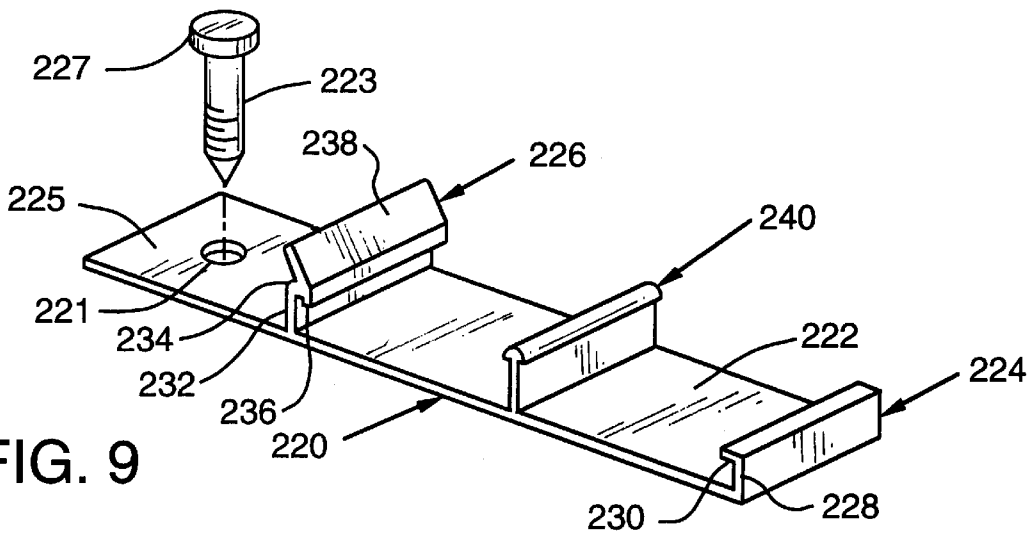
FIG. 9 is an exploded isometric view of a further embodiment of a connector used to form a floor assembly.
Figure 10:
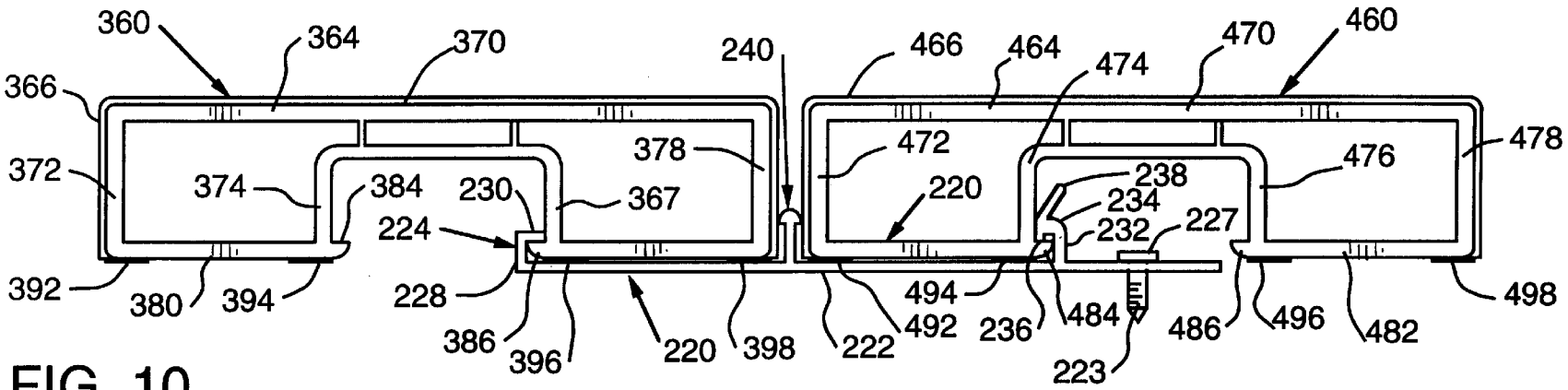
FIG. 10 is an end view illustrating a floor assembly as assembled utilizing the embodiment of the connector shown in FIG. 9.

Referring to FIGS. 9 and 10, there is shown another embodiment of a connector 220 for connecting the first extrusion 360 and the second extrusion 460. The connector 220 includes a base 222, a first end flange 224, a second end flange 226 and an intermediate flange 240. These components of the connector 220 operate essentially the same as for the connector 20 as described herein. In addition, the connector 220 includes a tab 225 extending from the base 222 adjacent the second end flange 226. An aperture 221 is formed in the tab 225. A fastening means, such as a screw 223 or other similar means, is received through the aperture 221 for securing, if desired, the connector 220 to the sub-floor structure S (FIG. 10) underlying the floor assembly. The tab 225 extending from base 222 is necessary for use with the extrusion 360 and 460 having the horizontal support members 380, 382 and 480, 482, respectively. As shown in FIG. 10, the tab 225, once the first extrusion 360 and second extrusion 460 are connected to the connector 220, is positioned intermediate a first inner leg member 474 and the second inner leg member 476. This prevents the horizontal support members 480 and 482 of the second extrusion 460 from contacting or otherwise engaging the head 227 of screw 223 which may cause the formation of an uneven floor assembly.

It will be appreciated that a floor assembly having a novel and unique extrusion and connection arrangement is provided by the present invention. Advantageously, the floor assembly provides for quick and simple assembly and/or disassembly of the floor assembly, if desired. This allows for a temporary floor assembly to be constructed at a desired location without the need for a more permanent underlying support structure. Accordingly, the floor assembly and method of making the floor assembly disclosed herein provide an improved floor assembly which can be conveniently assembled and/or disassembled, as well as economically produced, that has improved structural integrity and durability in comparison to prior art floor assemblies presently known.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A floor assembly comprising:

at least two elongated extrusions disposed adjacent to each other, each said extrusion including a pair of outer leg members and a pair of inner leg members; and a connector for connecting a first said extrusion to a second said extrusion, said connector engaging said inner leg member and said outer leg member of said first extrusion and said outer leg member and said inner leg member of said second extrusion.

2. The floor assembly of claim 1, wherein:

said connector includes a base and a pair of end flanges extending from opposed ends of said base, a first said end flange engaging said inner leg member of said first extrusion and a second said end flange engaging said inner leg member of said second extrusion.

3. The floor assembly of claim 2, wherein:

said first end flange defines a first recessed space; and said inner leg member of said first extrusion includes a foot section which engages into said first recessed space in order to resist undesired movement of said first extrusion with respect to said connector.

4. The floor assembly of claim 3, wherein:

said first end flange has (i) a first section which extends generally perpendicularly from said base and (ii) a second section which extends inwardly and generally perpendicularly in from said first section.

5. The floor assembly of claim 4, wherein:

said second end flange defines a second recessed space; and said inner leg member of said second extrusion includes a foot section which engages into said second recessed space in order to resist undesired movement of said second extrusion with respect to said connector.

6. A floor assembly comprising:

at least two elongated extrusions disposed adjacent to each other, each said extrusion including a pair of outer leg members and a pair of inner leg members, a connector for connecting a first said extrusion to a second said extrusion said connector engaging said inner leg member and said outer leg member of said first extrusion and said outer leg member and said inner leg member of said second extrusion;

said connector includes a base and a pair of end flanges extending from opposed ends of said base, a first said end flange engaging said inner leg member of said first extrusion and a second said end flange engaging said inner leg member of said second extrusion;

said first end flange defines a first recessed space;

said inner leg member of said first extrusion includes a foot section which engages into said first recessed space in order to resist undesired movement of said first extrusion with respect to said connector;

said first end flange has a first section which extends generally perpendicularly from said base and a second section which extends inwardly and generally perpendicularly in from said first section;

said second end flange defines a second recessed space;

said inner leg member of said second extrusion includes a foot section which engages into said second recessed space in order to resist undesired movement of said second extrusion with respect to said connector; and said second end flange has (i) a first section extending generally perpendicularly from said base; (ii) a second section extending inwardly and generally perpendicularly to said first section; (iii) a third section extending downwardly and generally perpendicularly to said second section; and (iv) a pilot surface extending angularly from said second section to facilitate pushing down said inner leg member of said second extrusion so that it snaps into said second recessed space.

7. The floor assembly of claim 6, wherein said connector includes an intermediate flange extending generally perpendicularly from said base and between said first and second end flanges, said intermediate flange being disposed in a space defined between said first and second extrusions.

8. The floor assembly of claim 2 including:

a tab projecting from said end of said base on which said second end flange is disposed, whereby said tab can be used to secure said base, if desired, to a subfloor structure underlying said floor assembly.

9. The floor assembly of claim 1, wherein:

said extrusions are made of plastic and said connector is made of aluminum.

10. The floor assembly of claim 1, including:

a plurality of extrusions disposed adjacent to each other, each pair of adjacent said extrusions being connected by at least one said connector.

11. The floor assembly of claim 10, wherein said pair of adjacent said extrusions are connected by a plurality of connectors.

12. The floor assembly of claim 1, including:

a horizontal support member extending between said outer leg member and an adjacent said inner leg member.

13. The floor assembly of claim 1, wherein:

each of said extrusions is made of a resilient material and bends when each of said extrusions is pressed onto said connector and then snaps to mechanically secure each of said elongated extrusions to said snap connector.

14. A floor assembly comprising:

at least two elongated extrusions disposed adjacent to each other, each said extrusion including a pair of outer leg members and a pair of inner leg members;

a connector for connecting a first said extrusion to a second said extrusion, said connector engaging said inner leg member and said outer leg member of said first extrusion and said outer leg member and said inner leg member of said second extrusion;

said connector includes a base and a pair of end flanges extending from opposed ends of said base, a first said end flange engaging said inner leg member of said first extrusion and a second said end flange engaging said inner leg member of said second extrusion;

said first end flange defines a first recessed space;

said inner leg member of said first extrusion includes a foot section which engages into said first recessed space in order to resist undesired movement of said first extrusion with respect to said connector; and said first end flange has (i) a first section extending generally perpendicularly from said base; (ii) a second section extending inwardly and generally perpendicularly to said first section; (iii) a third section extending downwardly and generally perpendicularly to said second section; and (iv) a pilot surface extending angularly from said second section to facilitate pushing down said inner leg member of said first extrusion so that it snaps into said first recessed space.

15. The floor assembly of claim 14, wherein:

said second end flange defines a second recessed space; and said inner leg member of said second extrusion includes a foot section which engages into said second recessed space in order to resist undesired movement of said second extrusion with respect to said connector.

16. The floor assembly of claim 15, wherein said second end flange has (i) a first section extending generally perpendicularly from said base; (ii) a second section extending inwardly and generally perpendicularly to said first section; (iii) a third section extending downwardly and generally perpendicularly to said second section; and (iv) a pilot surface extending angularly from said second section to facilitate pushing down said inner leg member of said second extrusion so that it snaps into said second recessed space.

17. A method of making a floor assembly comprising:

providing a first extrusion, said first extrusion having (i) a first outer leg member; (ii) a second outer leg member; (iii) a first inner leg member; and (iv) a second inner leg member;

providing a second extrusion, said second extrusion having (i) a first outer leg member; (ii) a second outer leg member; (iii) a first inner leg member; and (iv) a second inner leg member;

providing a first connector;

attaching said first connector to said second inner leg member of said first extrusion; and securing said first inner leg member of said second extrusion to said first connector in order to form the floor assembly made of said first and second extrusions.

18. The method of claim 17, including:

providing a third extrusion, said third extrusion having (i) a first outer leg member; (ii) a second outer leg member; (iii) a first inner leg member; and (iv) a second inner leg member;

providing a second connector;

before securing said second extrusion to said first connector, attaching said second connector to said second inner leg member of said second extrusion;

subsequently securing said first inner leg member of said second extrusion to said first connector; and securing said first inner leg member of said third extrusion to said second connector to form a floor assembly made of said first, second and third extrusions.

19. The method of claim 18, including repeating the method steps of claims 14 and 15 with each new extrusion to be added to said floor assembly.

20. The method of claim 17, including disassembling said floor assembly by unattaching both of said first and second extrusions from said first connector.

21. The method of claim 18, including disassembling said floor assembly by unattaching (i) said first and second extrusions from said first connector and (ii) said second and third extrusions from said second connector.

22. A method of making a floor assembly comprising:

providing a first extrusion, said first extrusion having (i) a first outer leg member; (ii) a second outer leg member; (iii) a first inner leg member; and (iv) a second inner leg member;

providing a second extrusion, said second extrusion having (i) a first outer leg member;. (ii) a second outer leg member; (iii) a first inner leg member; and (iv) a second inner leg member;

providing a connector;

securing one of said first extrusion and said second extrusion to said connector; and securing the other of said first extrusion and said second extrusion to said connector in order to form the floor assembly made of said first and second extrusions.

* * * * *